US005197249A

United States Patent [19]

Wiand

[11] Patent Number: 5,197,249

[45] Date of Patent: Mar. 30, 1993

[54] DIAMOND TOOL WITH NON-ABRASIVE SEGMENTS

[76] Inventor: Ronald C. Wiand, 1494 Heatherwood Dr., Troy, Mich. 48098

[21] Appl. No.: 875,209

[22] Filed: Apr. 27, 1992

Related U.S. Application Data

[63] Continuation of Ser. No. 651,808, Feb. 7, 1991, abandoned.

[51] Int. Cl.[5] ..... B24D 11/00

[52] U.S. Cl. ..... 51/397; 51/395; 51/398

[58] Field of Search ..... 51/131.4, 131.5, 132, 51/206.4, 206.5, 209 DL, 395-398, 407, DIG. 34, 204, 401, 402, 405

[56] References Cited

U.S. PATENT DOCUMENTS

| | | | |
|---|---|---|---|
| 1,507,836 | 9/1924 | King | 51/398 |
| 2,907,146 | 10/1959 | Dyar | 51/DIG. 34 |

FOREIGN PATENT DOCUMENTS

| | | | |
|---|---|---|---|
| 164759 | 9/1953 | Australia | 51/397 |
| 619539 | 5/1961 | Australia | 51/397 |
| 345239 | 12/1989 | European Pat. Off. | 51/131.4 |
| 74990 | 6/1977 | Japan | 51/DIG. 34 |
| 1827 | of 1862 | United Kingdom | 51/397 |
| 106166 | 5/1917 | United Kingdom | 51/398 |
| 2043501 | 10/1980 | United Kingdom | 51/DIG. 34 |

*Primary Examiner*—Bruce M. Kisliuk
*Assistant Examiner*—John A. Marlott
*Attorney, Agent, or Firm*—Harnes, Dickey & Pierce

[57] ABSTRACT

A segmented type abrasive pad for use in stone finishing industries. The pad is less expensive than prior segmented pads and has increased life due to the inclusion of non-abrasive load bearing segments. The non-abrasive segments allow for the use of less diamond segment material without sacrificing performance or longevity of the pad.

8 Claims, 1 Drawing Sheet

DIAMOND TOOL WITH NON-ABRASIVE SEGMENTS

This is a continuation of U.S. Pat. No. 651,808, filed Feb. 7,1991, now abandoned.

BACKGROUND OF THE INVENTION

The present invention relates to a novel abrasive segment type abrasive pad. More particularly, the present invention relates to an abrasive segment type abrasive pad which has reduced cost and longer wear characteristics due to the introduction of non-abrasive segments in the pad structure.

Segmented abrasive disks are known in the art for polishing of stone, granite or marble. Such segmented disks have a backing substrate and a plurality of abrasive segments attached thereto in various formations. The abrasive segments generally comprise a resin or polymer material which has diamond grit abrasive particles interspersed therein to provide the requisite abrasive characteristics. These segments generally have a multi-layer of diamond particles and have a thickness generally from about ⅛ to about ½ inch, depending on the particular application. Because of the use of the interspersed diamond grit particles in the segments such segmented type disks are expensive to produce. However, the finishing characteristics of such an abrasive pad provide advantages which make the costs worthwhile. Because of this relatively high cost it has been desirable in the art to use the least amount of abrasive segments which can adequately finish this surface in the desired manner.

In the past, it was believed that minimizing the amount of segments utilized in such a disk would maximize the cost effectiveness of a disk. However, some disadvantages were found in merely reducing the amount of segments or surface area of the segments utilized on such a disk. For instance, with reduction in the segment surface area, more load was placed on each of the individual abrasive segments. This caused inefficient frictional wear of the abrasive diamond segments, thus, reducing the useful life of the abrasive pad. Additionally, it was found that with reduction in the number of segments used the greater spacing between the segments caused problems when polishing or grinding of surfaces having steps or edges or other uneven obstructions. It was found that such spaced segment configurations tended to catch the edge of the work piece as the pad traversed the edge. This would cause chipping of the abrasive segment and/or work surface thereby interposing the chipped portion in between the abrasive segment and the surface. This may result in undesirable scratching of the work surface.

Thus, it has been a goal in the art to reduce the costs of such pads by reducing the amount of abrasive segment material utilized without the disadvantages as noted above.

SUMMARY OF THE INVENTION

In accordance with the present invention there is provided an abrasive pad which has a backing substrate and a means for attachment to a rotary tool. The abrasive pad of the present invention includes a plurality of abrasive segments, which have a predetermined thickness, attached to the backing substrate. These plurality of abrasive segments are spaced about the pad and collectively form a co-planar abrasive surface. A plurality of non-abrasive segments are spaced between the abrasive segments in the present invention. The non-abrasive segments have a thickness and include a face surface which is co-planar with the co-planar abrasive surface. In the present invention, the use of these non-abrasive segments distributes the load imposed on the abrasive pad between these non-abrasive surfaces and the abrasive surfaces for reducing the frictional wear of the abrasive segments and for solving the problem of chipping. Additionally, less diamond segment material may be utilized without loss of effectiveness of the pad, therefore, the overall cost of the abrasive pad is reduced.

Further advantages of the present invention will become known to those skilled in that art in light of the following drawings when considered with the description of the preferred embodiment and the claims set forth below.

DESCRIPTION OF THE PREFERRED EMBODIMENT

Figure 1:
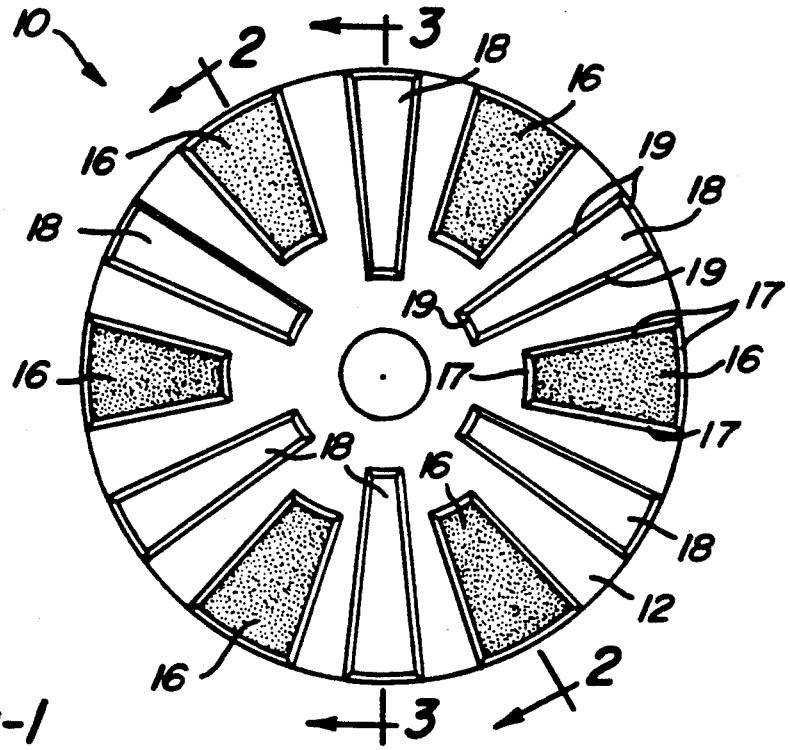
FIG. 1 is a plan view showing an abrasive disk made in accordance with teachings of the present invention.
Figure 2:
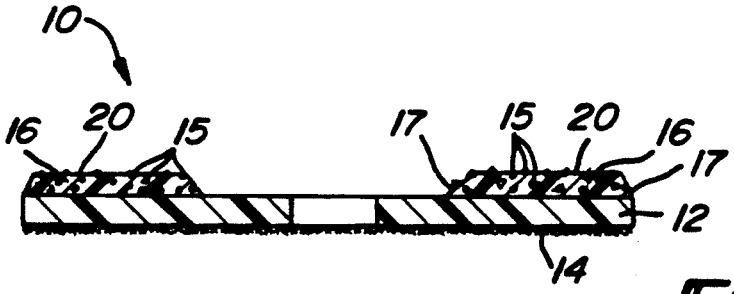
FIG. 2 is a sectional view taken along line 2—2 of FIG. 1 showing a section of the abrasive segments.
Figure 3:
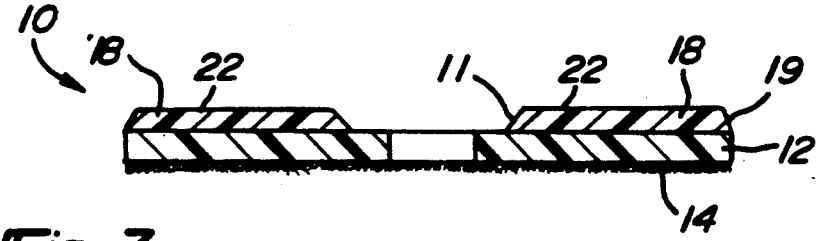
FIG. 3 a sectional view taken along line 3—3 of FIG. 1 showing a section of the non-abrasive segments.

In accordance with the present invention there is provided a novel abrasive pad, generally shown at 10. The abrasive pad 10 includes a backing substrate 12 with a means for attachment of the pad to a rotary tool (not shown), the means for attachment may be any of the fabric type fasteners such as a velcro hook or loop type fabric fastener 14. A plurality of abrasive segments 16 are attached to the backing substrate by adhesives or the like for providing the abrasive characteristics to the pad. Non-abrasive segments 18 are interspersed among the abrasive segments 16. The non-abrasive segments 18 allow distribution of the load between the non-abrasive segments and abrasive segments, thereby reducing frictional wear on the abrasive segment and reducing the amount of abrasive segments necessary. The abrasive segments 16 are of common construction in the art and generally include abrasive grit particles 15, preferably diamond grit particles, which are interspersed throughout a polymeric or resin type binder material. Generally, abrasive segments 16 which are used on these pads have a thickness of from about ⅛ of an inch to ½ inch. Such abrasive segments 16 are designed such that they will wear away, during use, to continually expose new grit material. In a preferred embodiment, the segments are truncated pie slice shapes with radially inner and outer curved edges. The abrasive segments 16 are adhesively attached to the substrate 12. The abrasive segments 16 preferably include chamfered edges 17 about the periphery. The chamfered edges 17 are somewhat advantageous when utilizing such pads on uneven surfaces. If a rough part or edge of a surface is encountered, the chamfered edges 17 will assist in traversal of the edge. The plurality of segments 16 collectively define a co-planar abrasive surface which is best shown in FIG. 2 by reference numeral 20. Thus, each of the abrasive segments 16 are of equal thickness such that the coplanar abrasive surface 20 is operable for cutting during rotation of the pad during grinding.

The improvement of the present invention is in the plurality of non-abrasive segments 18 which are utilized in the abrasive pad structure of this invention. The non-abrasive segments 18 are produced of the same or similar wearing polymer material used in the abrasive segments 16. Thus, the non-abrasive segments 18 are designed to wear at the same rate as the abrasive segments 16. In the present invention the non-abrasive segments 18 are the same thickness as the abrasive segments used and include the non-abrasive face surface 22 which collectively among the non-abrasive segments 18 define a surface which is co-planar to the surface 20 of the abrasive segments. The non-abrasive segments 18 also have chamfered edges 19 on the peripheral edges and are configured in a truncated pie slice type shape.

During operation of the rotational pad the non-abrasive segments 18 act as a load bearing surface which distributes the load forces, imposed on the pad during use, between the non-abrasive surfaces 22 and the abrasive surfaces 20.

In the present invention, the non-abrasive segments 18 are made of a relatively inexpensive polymer material and do not include expensive diamond grit particles therein. Thus, the pad itself has a lesser number of abrasive segments thereby reducing the cost of the pad without sacrificing performance characteristics. In addition, because the non-abrasive segments 18 are load bearing and wear at the same rate as the abrasive segments 16, the non-abrasive segments 18 protect the abrasive segments 16 from undue wear which lengthens the life of the abrasive segments 16 and therefore lengthens the useful life of the abrasive pad. In a preferred embodiment the non-abrasive segments 18 extend radially inwardly beyond the radially inward edge of the abrasive segments 16 to further distribute loads imposed on the pad.

A circular pad is shown herein as a preferred embodiment wherein the abrasive segments are equiangularly situated on the pad with the non-abrasive segments equiangularly spaced between each pair of abrasive segments 16. However, as will be readily appreciated by those skilled in the art that non-abrasive load bearing segments could be advantageously used in other pad structures and in other configurations than the embodiment shown without deviating from the teachings of the present invention.

While the above disclosure sets forth a preferred embodiment of the present invention, it will be readily appreciated by those skilled in the art that the present invention may be subject to modification, variation and change without departing from the scope of the present invention. Accordingly, it is intended that the scope of the present invention be limited only by the following claims.

What is claimed is:

1. An abrasive pad comprising:

a backing substrate including a means for attachment to a rotary tool;

a plurality of abrasive segments having a thickness attached to the backing substrate, said plurality of abrasive segments being spaced about the pad and being raised from said backing substrate, and each of said abrasive segments having an abrasive surface for defining a co-planar abrasive surface during rotation of the pad;

a plurality of non-abrasive segments attached to said backing substrate, said plurality of non-abrasive segments positioned between said abrasive segments, said plurality of non-abrasive segments having a thickness and being raised from said backing substrate, and each of said non-abrasive segments having a face surface which is co-planar with said co-planar abrasive surface;

and a gap between adjacent abrasive and non-abrasive segments;

whereby the load imposed on the abrasive pad is distributed between said abrasive surface and said non-abrasives surfaces for reducing frictional wear on said abrasive segments.

2. The abrasive pad of claim 1 wherein said abrasive segments are equiangularly spaced about the substrate with non-abrasive segments equiangularly spaced between the abrasive segments.

3. The abrasive pad of claim 2 wherein the non-abrasive segments radially have a greater length than said abrasive segments.

4. The abrasive pad of claim 3 wherein said abrasive segments and said non-abrasive segments have a generally truncated pie slice shape.

5. The abrasive pad of claim 4 wherein said abrasive segments comprise diamond grit particles interspersed throughout a polymeric binder material.

6. The abrasive pad of claim 5 wherein said abrasive segments and non-abrasive segments each have a thickness of from about $\frac{1}{8}$ inch to $\frac{1}{2}$ inch.

7. The abrasive pad of claim 6 wherein said abrasive segments have chamfered edges.

8. The abrasive pad of claim 7 wherein said non-abrasive segments have chamfered edges.

* * * * *